United States Patent [19]

Pote, Jr.

[11] Patent Number: 4,511,142

[45] Date of Patent: Apr. 16, 1985

[54] GOLF TRAINING DEVICE

[75] Inventor: Robert L. Pote, Jr., Mt. Vernon, Ind.

[73] Assignee: Tempo, Inc., Mount Vernon, Ind.

[21] Appl. No.: 493,019

[22] Filed: May 9, 1983

[51] Int. Cl.[3] ..... A63F 7/06; A63B 69/36

[52] U.S. Cl. ..... 273/87.4; 273/193 B

[58] Field of Search ..... 273/87.4, 181 A, 195 A, 273/77 A, 87.2, 129 W, 193 R, 194 R, 193 B

[56] References Cited

U.S. PATENT DOCUMENTS

| | | | |
|---|---|---|---|
| 731,825 | 6/1903 | Voorhees | 273/87.4 |
| 1,136,465 | 4/1915 | Clark | 273/87.4 |
| 3,190,657 | 6/1965 | Johnson | 273/181 A |
| 3,414,266 | 12/1968 | Mitchell | 273/195 A X |

*Primary Examiner*—George J. Marlo

*Attorney, Agent, or Firm*—Warren D. Flackbert

[57] ABSTRACT

A golf training device characterized as a miniaturized model of a player arranged to simulate, through hand control, swinging action, as well as weight shifting, through a full 270° to 360° back and forward range, for instructional and amusement purposes. The device permits selective club replacement and, with the provision of a resilient or sponge base, demonstrates and/or permits upwardly and downwardly positioning of the club on the ball. The device incorporates a supporting portable hitting surface representative of both the fairway and rough terrain. The device further includes simulated hands for grasping the club, where the latter, if improperly held, results in undesired hooking, slicing or like effects.

8 Claims, 6 Drawing Figures

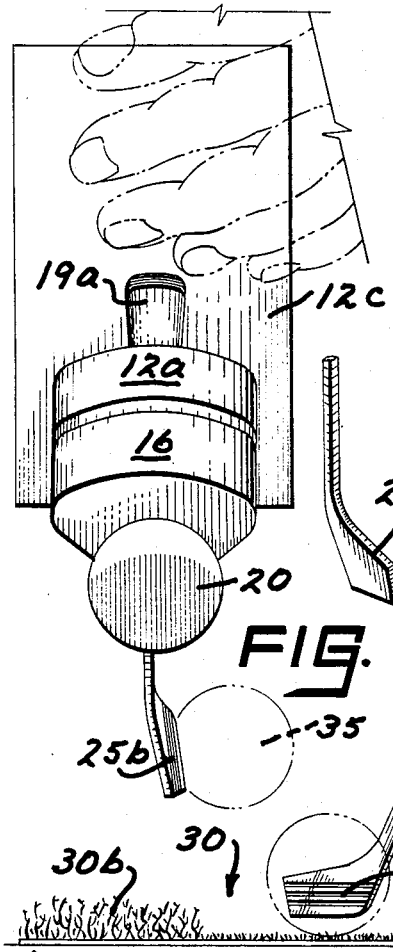
FIG. 1
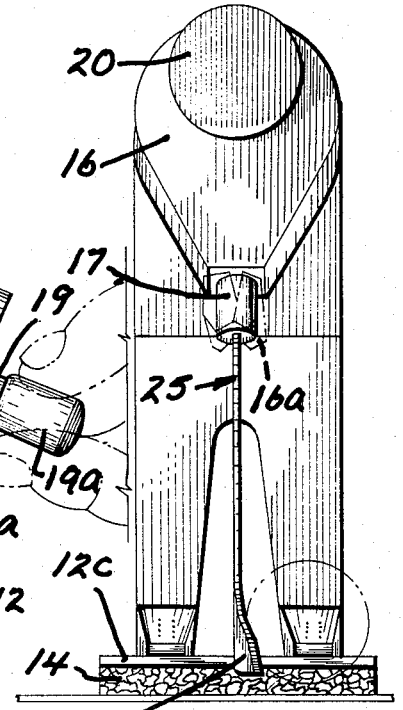
FIG. 2
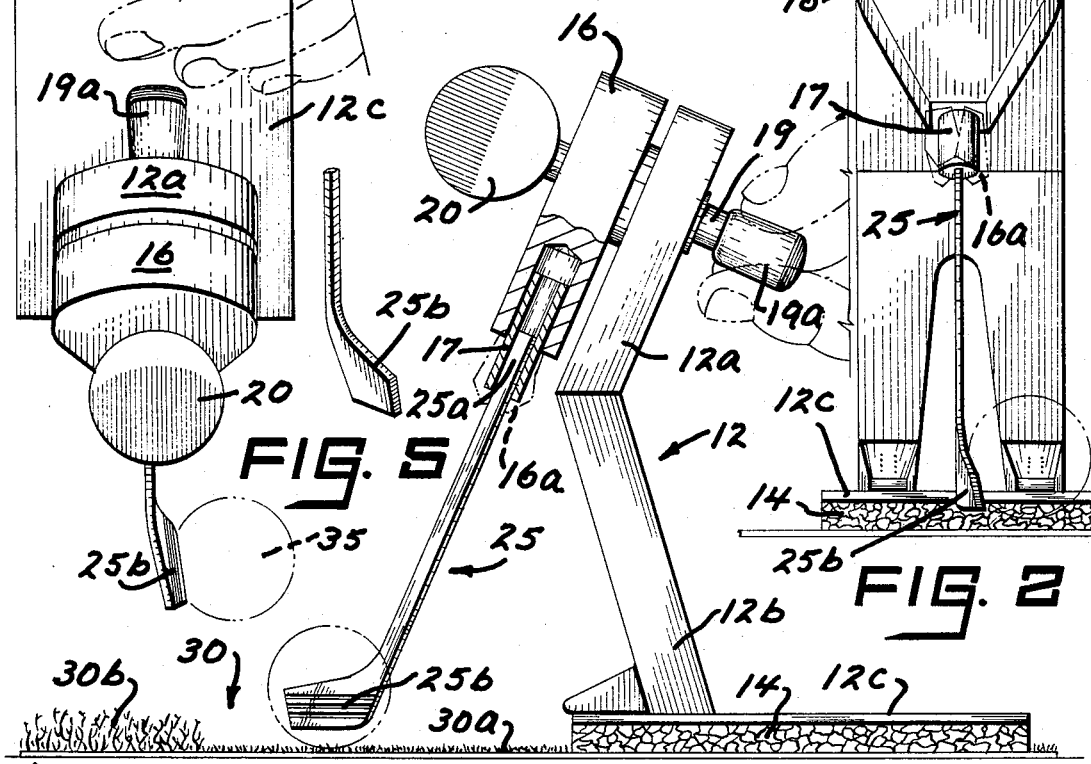
FIG. 5
FIG. 3
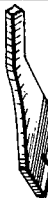
FIG. 6
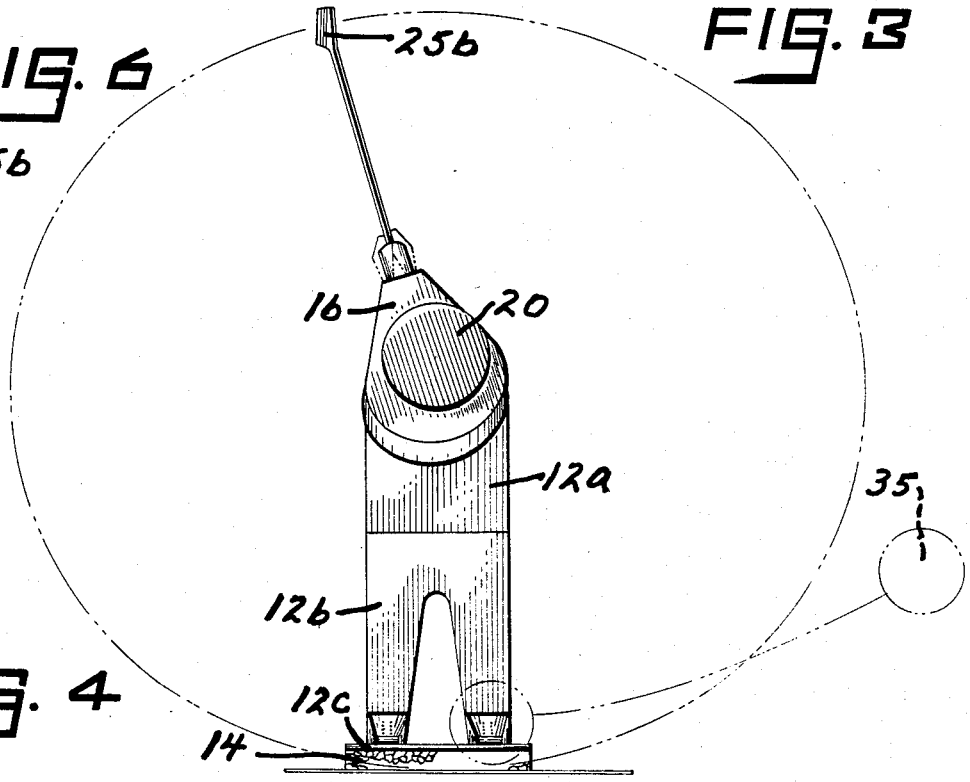
FIG. 4

GOLF TRAINING DEVICE

As is known, the popularity of the game of golf is widespread and growing, where the player, either new to the game or advanced in ability, continually seeks new skills and/or techniques for game improvement. In this connection, while much reading material is available for reference and/or study, a player, in the form of a miniaturized model, operated by hand(s), for simulating a golf swing, together with other associated playing factors, such as golf club choice and position, the type of playing surface involved and/or the like, has been deemed to be a valuable teaching objective and, accordingly, the invention herein presents such a need.

Broadly, the golf training device described and claimed herebelow simulates a player's swinging action, i.e. backward and forward throughout a 270° to 360° range; permits substitution of golf clubs, press fit into and between player-like hand areas, for the proper placement of the head of the golf club with respect to the golf ball, the latter looking toward the control of slicing, hooking, and/or ball backspin; affords a simulated playing surface on which the miniaturized player model may be variously located, such including portions representing the fairway and the rough; employs a resilient or spongelike base for the simulation of leveling action, i.e. basic preparation prior to hitting the golf ball, including the weight shifting aspect of the player model; and, promotes true golf swing tempo in that the player model combines arms, chest and shoulder movement, as a unit, upon rotation of a control knob.

In any event, the preceding represents only certain of the salient features of the total invention, where others will also become more apparent from the following description, taken in conjunction with the accompanying drawing, wherein FIG. 1 is a top plan view of a golf training device in accordance with the teachings of the present invention;

FIG. 2 is a view in front elevation, looking from the bottom to the top of FIG. 1;

FIG. 3 is a view in side elevation of the instant golf training device, illustrating in more detail the simulated playing surface used in connection therewith;

FIG. 4 is another view in front elevation, comparable to that of FIG. 2, but showing the pattern or movement of the golf club swing, in phantom, and the path of movement of a golf ball from an initial driving position, also shown in phantom;

FIG. 5 is a fragmentary view of the head of a golf club with a closed face; and, FIG. 6 is another fragmentary view of the head of a golf club, but, in this instance, with an open face.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the golf training device of the invention, typically made from an injection molded plastic resin, is defined by an upstanding body frame 12, representative of torso 12*a* and legs-feet 12*b* of the simulated player, mounted on a supporting base 12*c* onto the undersurface of which a resilient layer or cushion 14, as sponge or foam material, is adhesively or otherwise secured. The aforesaid torso 12*a* of the upstanding body frame 12 includes, adjacent thereto, a rotatable body portion 16 representative, by a mostly continuous smoothly curved edge surface, of the arms, chest and shoulders of the player.

A shaft 19, having a control knob 19*a* at one end, extends through the aforesaid torso 12*a* of the upstanding body frame 12 and the rotatable body portion 16, terminating at a spherical member 20 representative of the player's head. While not detailed herein, the preceding arrangement is such that by rotation of the control knob 19*a*, the body portion 16 also rotates, the latter being capable of extending through a driving range in the order of 270° to 360°, both backwardly and forwardly.

The body portion 16 includes at its lower end, i.e. below the shoulders and simulated arms, an opening for receiving a cylinder 17, where the latter is adapted to selectively position therewithin the end of any desired golf club 25 in a press fit relationship. As evident in FIGS. 2, 4 and 5 (represented by phantom lines), simulated hands 16*a* are provided in a simulated gripping relation with respect to handle-shaft 25*a* of the golf club 25.

As to the golf club 25, the aforesaid press fit positioning permits the proper placement thereof within the cylinder 17 presented in the rotatable body portion 16. FIG. 5 fragmentarily shows a golf club head 25*b* with a closed face, where, in contrast, FIG. 6 discloses a showing of the golf club head 25*b* with an open face. In other words, physical instruction as to proper facing is afforded in order to prevent and control hook, slice, ball backspin or the like.

As particularly evident in FIGS. 2 and 3, the golf training device presented herein also includes a playing surface 30, as in the form of a mat onto which the cushioned supporting base 12*c* can be selectively located, also depending upon the desired teaching objectives. In this connection, the mat or surface 30 includes a fairway portion 30*a* and a rough portion 30*b*, simulating actual golfing conditions.

The aforedescribed components achieve various desirable end results, including the following:

(1) A 270° to 360° full backward and forward swing is allowed.

(2) The swing pivot incorporates a simulated combination of a player's chest and shoulders.

(3) The device aptly illustrates two hand control, allowing body weight shift onto the golf ball 35, as through pressing action onto the supporting base 12*c* with one of the user's hands (shown in phantom in FIG. 1), where the user's other hand is operating the control knob 19*a*.

(4) The device is not restricted to board playing, i.e. such may function to allow play within an open room or area or from room or area to another room or area.

(5) The golf club handle-shaft 25*a* selective positioning, i.e. rotation arrangement, permits controlled hook, slice, ball backspin and the like.

(6) A proper golf swing is repeatedly simulated, affording correct swing tempo, where a poor swing results in reduced distance or an off-line or curved shot.

(7) The aforesaid playing mat or surface 30 serves to present various lies encountered in the actual game.

(8) The simulated hands 16*a*, typically made from a flexible material, add to overall swing tempo, if used.

Thus, the preceding should amply support the various features presented by the described golf training device, where it should be recognized that changes may be incorporated in the arrangement within the spirit of the invention, including, by way of example, in proportioning; the use of a flexible (as rubber or another resilient approach) lower torso for adding weight shift; the provision of a motorized back and forward swing; the choice of a particular golf ball type in accordance with instruction conditions; and, the like. Thus, the preceding should be considered illustrative and not as limiting the scope of the following claims:

I claim:

1. A golf training device comprising a miniaturized player model defined by a base supported upstanding body frame, a body portion rotatably mounted on said base supported upstanding body frame, a golf club selectively secured to said rotatable body portion simulating full swing golfing shots, and a resilient layer underlying and affixed to said base supported upstanding body frame, where the selective compression of portions of said resilient layer serves a player model weight distribution and shifting relationship.

2. The golf training device of claim 1 where said rotatable body portion is representative of the arms, chest and shoulders of said player model.

3. The golf training device of claim 1 where said golf club is rotatable to face in different directions.

4. The golf training device of claim 1 where a hand operated member controls movement of said rotatable body portion.

5. The golf training device of claim 1 where a playing surface underlies said resilient layer beneath said base supported upstanding body frame and said golf club.

6. The golf training device of claim 5 where said playing surface presents both a fairway and a rough simulating actual golfing conditions.

7. The golf training device of claim 5 where said upstanding body frame and said golf club are selectively locatable at various positions on said playing surface.

8. The golf training device of claim 1 where said base supported upstanding body frame is integral and incapable of turning movement upon independent rotation of said body portion.

* * * * *